US010794024B2

(12) United States Patent
Deshommes

(10) Patent No.: US 10,794,024 B2
(45) Date of Patent: Oct. 6, 2020

(54) SNOW AND ICE REMOVING ASSEMBLY

(71) Applicant: Jean-Philippe Deshommes, West Babylon, NY (US)

(72) Inventor: Jean-Philippe Deshommes, West Babylon, NY (US)

( * ) Notice: Subject to any disclaimer, the term of this patent is extended or adjusted under 35 U.S.C. 154(b) by 290 days.

(21) Appl. No.: 15/948,507

(22) Filed: Apr. 9, 2018

(65) Prior Publication Data

US 2019/0309492 A1 Oct. 10, 2019

(51) Int. Cl.

| | |
|---|---|
| ***E01H 10/00*** | (2006.01) |
| ***F04D 29/58*** | (2006.01) |
| ***F04D 25/08*** | (2006.01) |
| ***F04D 25/06*** | (2006.01) |

(52) U.S. Cl.

CPC ..... *E01H 10/007* (2013.01); *F04D 25/06* (2013.01); *F04D 25/08* (2013.01); *F04D 29/582* (2013.01)

(58) Field of Classification Search

CPC ..... E01H 10/007; F04D 25/06; F04D 25/08; F04D 29/582

See application file for complete search history.

(56) References Cited

U.S. PATENT DOCUMENTS

| | | | | |
|---|---|---|---|---|
| 4,108,143 | A * | 8/1978 | Pelsue | F24H 3/065 126/110 B |
| 6,089,477 | A | 7/2000 | Dillon | |
| 6,105,206 | A | 8/2000 | Tokumaru | |
| 6,840,468 | B2 * | 1/2005 | Barnett | A01C 7/02 239/152 |
| D533,266 | S | 12/2006 | Yoshida | |
| 7,281,675 | B2 | 10/2007 | Elrod | |
| 8,032,980 | B2 | 10/2011 | Basenberg, Jr. | |
| 2009/0101670 | A1 * | 4/2009 | Restive | A01M 7/0017 222/1 |
| 2009/0307936 | A1 * | 12/2009 | Rolsten | E01H 5/106 37/230 |
| 2012/0093490 | A1 * | 4/2012 | Steinberg | E01H 5/106 392/384 |
| 2017/0107679 | A1 * | 4/2017 | Schell | E01H 5/106 |

FOREIGN PATENT DOCUMENTS

| | | | | |
|---|---|---|---|---|
| CH | 704800 | A2 * | 10/2012 | B05B 9/0822 |

* cited by examiner

*Primary Examiner* — Jamie L McGowan

(57) ABSTRACT

A snow and ice removing assembly includes a housing that has a front wall, a back wall and a peripheral wall that extends between the front wall and the back wall. A hot air conduit is fluidly coupled to the housing and extends away from the front wall. An air warming unit is mounted in the housing and draws air into the housing through an air intake that extends through the housing. The air warming unit warms the air then forces the air outwardly of the housing through the hot air conduit when turned on. A container is positioned remote of the housing and holds a snow melting compound therein. A dispensing unit is mounted on the housing and is fluidly coupled to the container. The dispensing unit is actuated to extract the snow melting compound from the container and dispense the snow melting compound outwardly from the housing.

14 Claims, 4 Drawing Sheets

SNOW AND ICE REMOVING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to snow and ice removing devices and more particularly pertains to a new snow and ice removing device for removing snow and ice.

BRIEF SUMMARY OF THE INVENTION

An embodiment of the disclosure meets the needs presented above by generally comprising a housing that has a front wall, a back wall and a peripheral wall that extends between the front wall and the back wall. A hot air conduit is fluidly coupled to the housing and extends away from the front wall. An air warming unit is mounted in the housing. The air warming unit draws air into the housing through an air intake that extends through the housing and warms the air when the air warming unit is turned on. The air warming unit forces the air outwardly of the housing through the hot air conduit. A container is positioned remote of the housing and is configured to hold snow melting compound therein. A dispensing unit is mounted on the housing and is fluidly coupled to the container. The dispensing unit is actuated to extract the snow melting compound from the container and dispense the snow melting compound outwardly from the housing such that the snow melting compound melts the snow and the ice positioned on the ground surface. A power supply is mounted on the housing and is electrically coupled to the air warming unit and the dispensing unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
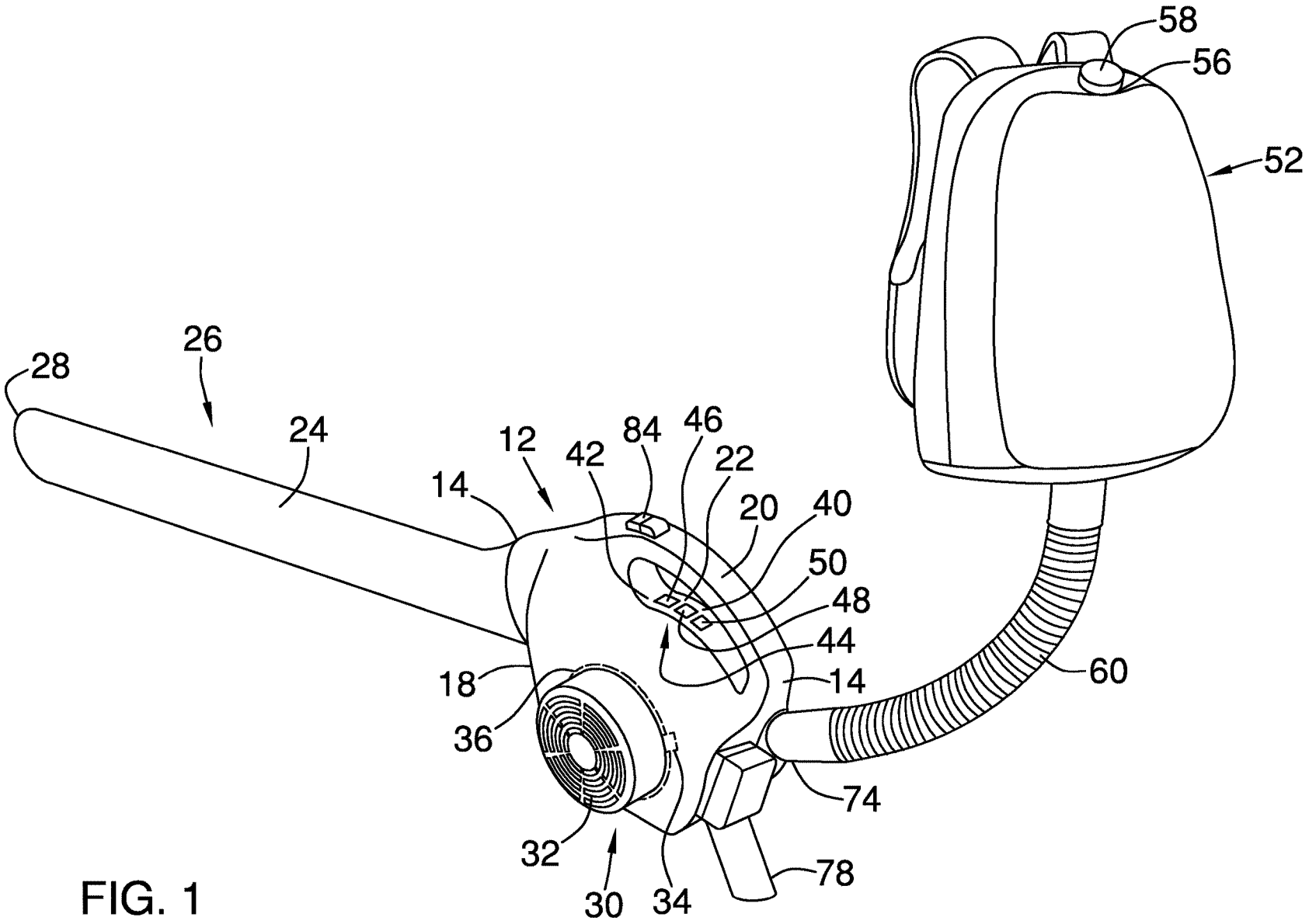
FIG. 1 is a perspective view of a snow and ice removing assembly according to an embodiment of the disclosure.
Figure 2:
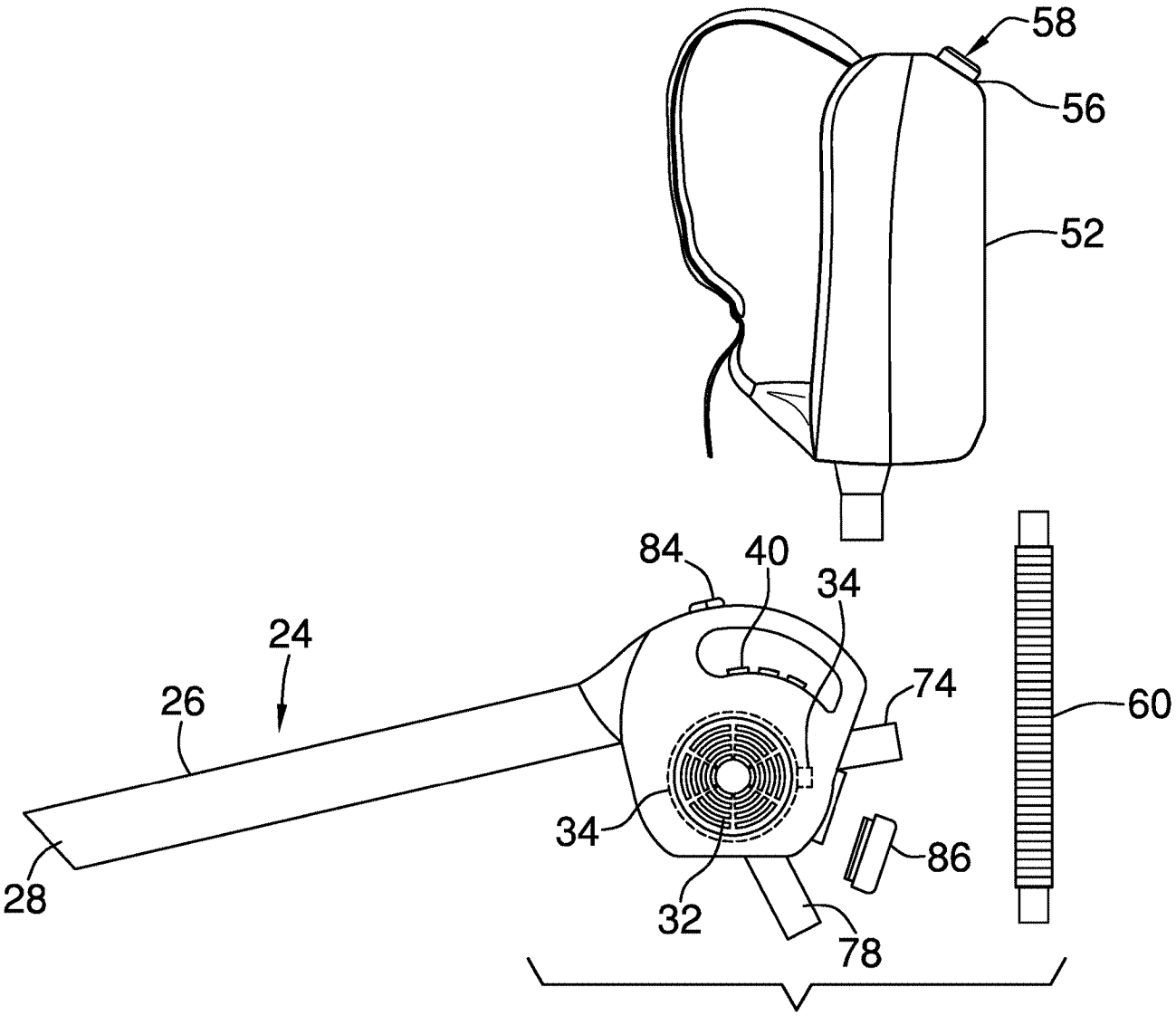
FIG. 2 is a side view of an embodiment of the disclosure.
Figure 3:
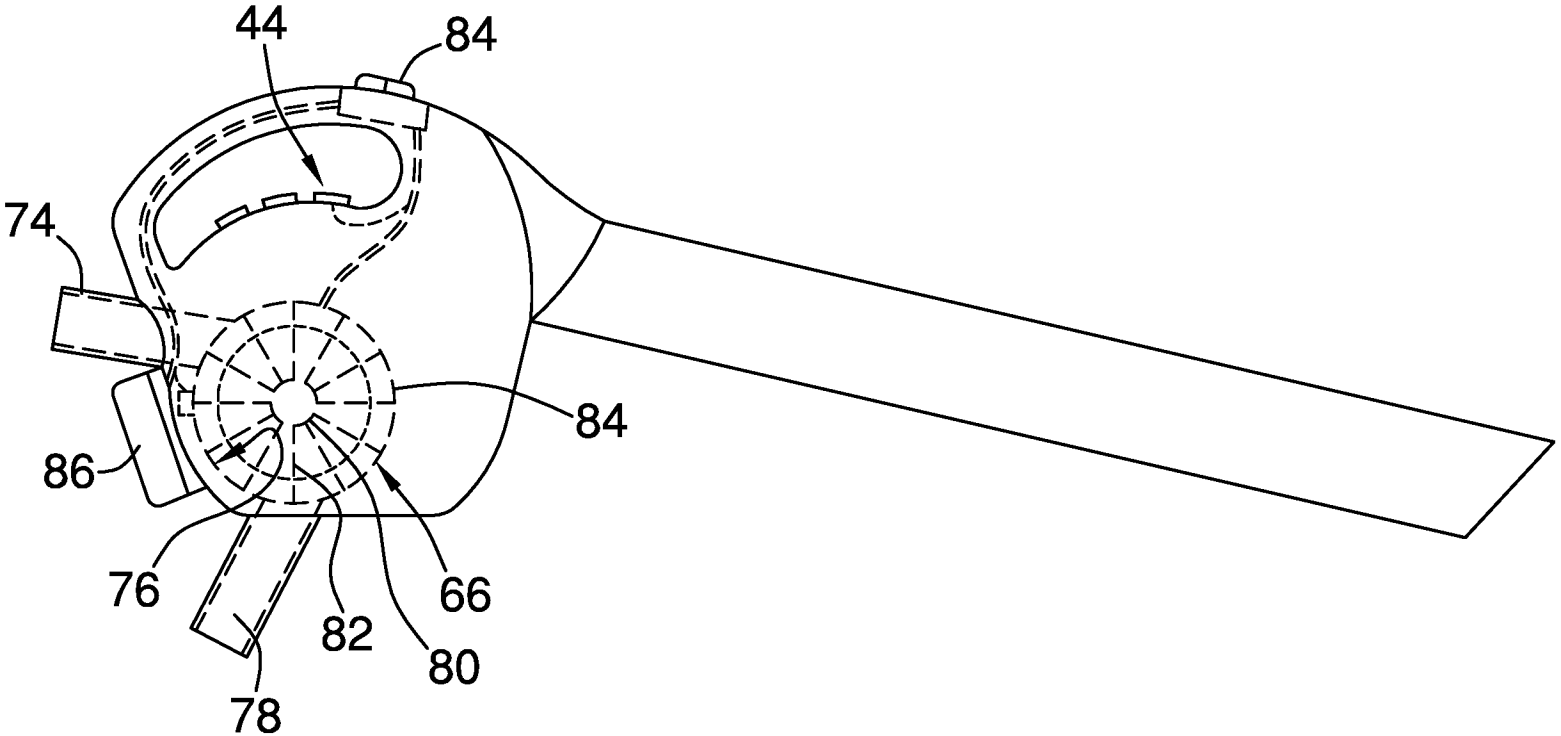
FIG. 3 is a side view of an embodiment of the disclosure.
Figure 4:
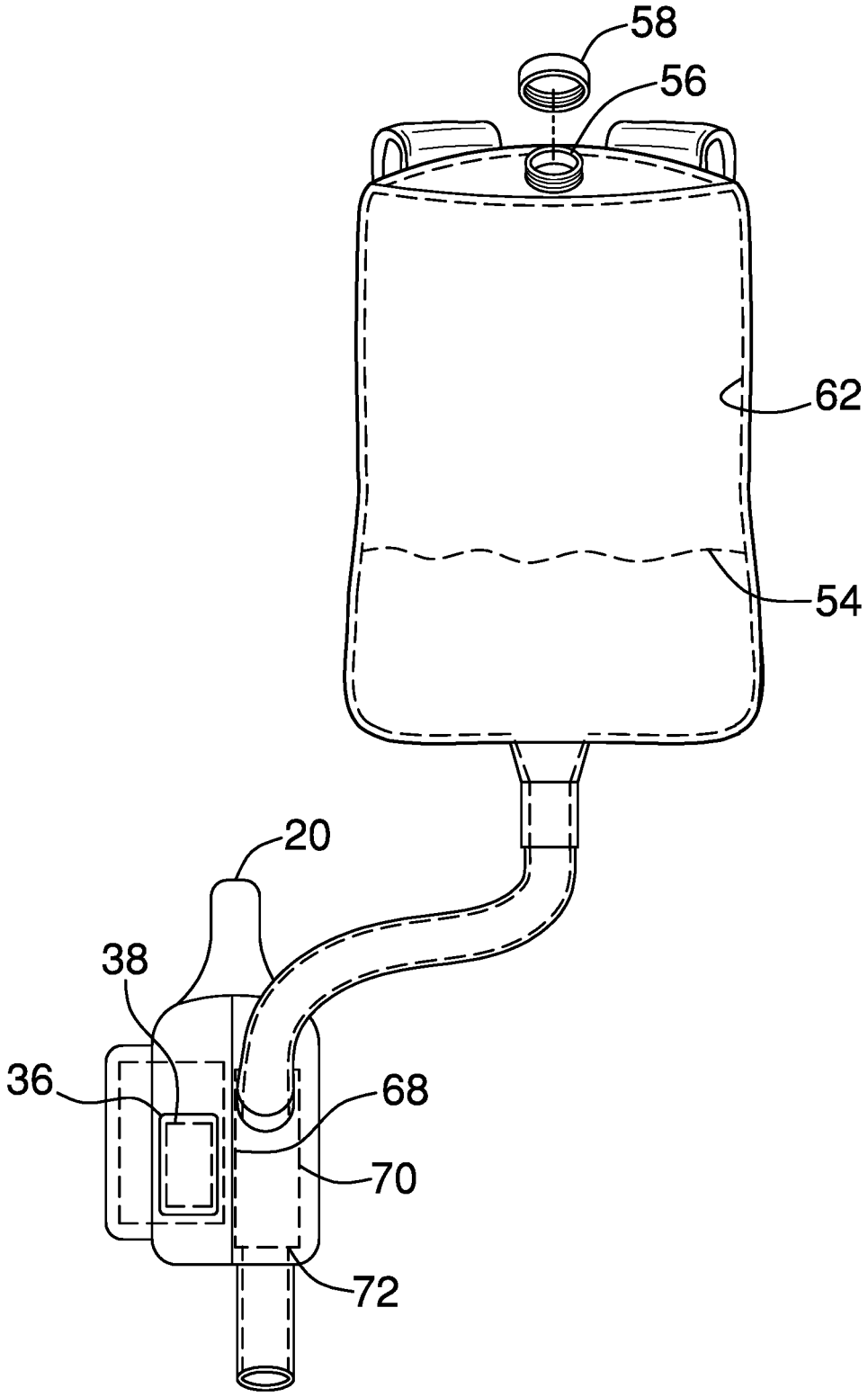
FIG. 4 is a rear view of an embodiment of the disclosure.

With reference now to the drawings, and in particular to FIGS. 1 through 4 thereof, a new snow and ice removing device embodying the principles and concepts of an embodiment of the disclosure and generally designated by the reference numeral 10 will be described.

As best illustrated in FIGS. 1 through 4, the snow and ice removing assembly 10 generally comprises a housing 12 that has a front wall 14, a back wall 16 and a peripheral wall 18 that extends between the front wall 14 and the back wall 16. A handle 20 is attached to a top side 22 of the housing 20. The handle 20 may be formed by the housing 12 or may be separate from the housing 12.

A hot air conduit 24 is fluidly coupled to the housing 12. The hot air conduit 24 extends away from the front wall 14. The hot air conduit 24 comprises an elongated tube 26 wherein the elongated tube 26 has an open distal end 28 relative to the housing 12. Moreover, the elongated tube 26 is rigid to direct the flow of air outwardly through the elongated tube 26.

An air warming unit 30 is mounted in the housing 12. The air warming unit 30 draws air into the housing 12 through an air intake 32 that extends through the housing 12. The air warming unit 30 warms the air and forces the air outwardly of the housing 12 through the hot air conduit 24 when the air warming unit 30 is turned on.

The air warming unit 30 comprises a control circuit 34 that is mounted in the housing 12. A heating element 36 is mounted in the housing 12 and is electrically coupled to the control circuit 34. The heating element 36 is in thermal communication with the air positioned within the housing 12 and is actuated to heat the air within the housing 12 to a preselected temperature.

A blower 38 is mounted in the housing 12 and is electrically coupled to the control circuit 34. The blower 38 is in fluid communication with the air heated by the heating element 36 and with the hot air conduit 24. Moreover, the blower 38 is actuated to take in the air from outside of the housing 12 through the air intake 32 wherein the heating element 36 warms the air and the blower 38 forces the air outwardly of the hot air conduit 24.

An input 40 is electrically coupled to the control circuit 34 and is actuated to turn on each of the heating element 36 and the blower 38. The input 40 includes a temperature selector 42 to selectively choose a one of a plurality of temperature levels at which the air is to be heated. The temperature levels are typically between 65° F. and 95° F. The temperature selectors 42 include a plurality of buttons 44 each of the buttons 44 turns on the heating element 36 and the blower 38. Moreover, each of the buttons 44 is associated with one of the heat levels. A selected one of the buttons 44 is actuated to warm the heating element 36 to the associated one of the heat levels. The buttons 44 may include a low heat button 46, a medium heat button 48 and a high heat button 50 for approximate temperature settings. The low heat button 46 may be associated with the 70° F. heat level, the medium heat button 48 is associated with the 80° F. heat level, and the high heat button 50 is associated with the 90° F. heat level. The heating element 36 is heated to the associated heat level when the button 44 is actuated.

A container 52 is positioned remote of the housing 12 and holds snow melting compound therein 54. The container 52 has a filling aperture 56 for receiving the container 52 with the snow melting compound 54. A cap 58 is removably positioned over the filling aperture 56. A hose 60 is attached to and extends outwardly from the container 52 wherein the hose 60 is fluidly coupled with an interior 62 of the container 52. The container 52 may comprise a backpack but may be any other container 52 suitable to hold the snow melting compound 54 within.

A dispensing unit 64 is mounted on the housing 12 and is fluidly coupled to the container 52. The dispensing unit 64 is actuated to extract the snow melting compound 54 from the container 52 and dispense the snow melting compound 54 outwardly from the housing 12 such that the snow melting compound 54 melts the snow and the ice positioned on the ground surface. The snow melting compound 54 may be comprised of salt or sand, but may be any other compound suitable to melt snow and ice.

The dispensing unit 64 comprises a chamber 66 that is mounted within the housing 12. The chamber 66 has a first lateral wall 68, a second lateral wall 70 and a perimeter wall 72 is attached to and extends between the first lateral wall 68 and the second lateral wall 70. An inlet pipe 74 is fluidly coupled to an interior 76 the chamber 66 and extends outwardly of the housing 12. The hose 60 is fluidly coupled to the inlet pipe 74 to fluidly couple the chamber 66 to the container 52. An outlet pipe 78 is also included and is fluidly coupled to the interior 76 of the chamber 66 and extends outwardly of the housing 12. The outlet pipe 78 extends downwardly from the housing 12. A motor 80 is mounted in the chamber 66. A spreader 82 is mounted in said chamber 66 and is mechanically coupled to the motor 80. The motor 80 is actuated to rotate the spreader 82 and move the melting compound 54 from said inlet pipe 74 and to the outlet pipe 78. The container 66 is coupled to the inlet pipe 74 at an angle that gravity pulls the snow melting compound 64 downwardly into the chamber 66. Rotation of the spreader 82 dispenses the snow melting compound 54 and creates space for more of the snow melting compound 54 within the chamber 66. A power switch 84 is mounted on the housing 12 and is electrically coupled to the motor 80. The power switch 84 is actuated to turn on the motor 80.

A power supply 86 is mounted on the housing 12 and is electrically coupled to the air warming unit 30 and the dispensing unit 64. The power supply 86 may comprises a rechargeable battery. In the rechargeable battery embodiment, the rechargeable battery is removable from the housing 12 to be placed in a recharging dock. However, the power supply 86 may comprise of any other power supply 86 and may alternatively be powered by a gas fueled engine mounted on the housing.

In use, the container 52 is filled with the snow melting compound 54. The input 40 is actuated and a selected one of the buttons 44 is actuated to turn on the blower 38 and the heating element 36. The air is blown outwardly of the hot air conduit 24 to melt and blow the snow away. The power switch 84 is actuated to turn on the motor 80 and rotate the spreader 82. The snow melting compound 54 is released outwardly through the outlet pipe 78. The snow melting compound 54 falls downwardly onto and melts the snow and the ice.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A snow and ice removal assembly comprising:

a housing having a front wall, a back wall and a peripheral wall extending between said front wall and said back wall;

a hot air conduit being fluidly coupled to said housing, said hot air conduit extending away from said front wall;

an air warming unit being mounted in said housing, said air warming unit drawing air into said housing through an air intake extending through said housing and warming the air when said air warming unit is turned on, said air warming unit forcing said air outwardly of said housing through said hot air conduit;

a container being positioned remote of said housing, said container being configured to hold snow melting compound therein;

a dispensing unit being mounted on said housing and being fluidly coupled to said container, said dispensing unit being actuated to extract the snow melting compound from said container and dispense the snow melting compound outwardly from said housing such that the snow melting compound melts the snow and the ice positioned on the ground surface;

a power supply being mounted on said housing, said power supply being electrically coupled to said air warming unit and said dispensing unit; and wherein said air warming unit comprises a control circuit being mounted in said housing, a heating element being mounted in said housing and being electrically coupled to said control circuit, said heating element being in thermal communication with the air positioned within said housing, said heating element being actuated to heat the air within said housing to a preselected temperature, a blower being mounted in said housing and being electrically coupled to said control circuit, said blower being in fluid communication with the air heated by said heating element, said blower being in fluid communication with said hot air conduit, said blower being actuated to take in the air from outside of said housing through said air intake wherein said heating element warms the air and forces the air outwardly of said hot air conduit, and an input being electrically coupled to said control circuit, said input being actuated to turn on each of said heating element and said blower, said input including a temperature selector to selectively choose a one of a plurality of temperature levels at which the air is to be heated.

2. The snow and ice removal assembly according to claim 1, further including a handle being attached to a top side of said housing.

3. The snow and ice removal assembly according to claim 1, wherein said hot air conduit comprises an elongated tube, said elongated tube having an open distal end relative to said housing, said elongated tube being rigid.

4. The snow and ice removal assembly according to claim 1, wherein said temperature levels are between 65° F. and 95° F.

5. The snow and ice removal assembly according to claim 1, wherein said container has a filling aperture for receiving the snow melting compound and a cap being removably positioned over said filling aperture.

6. The snow and ice removal assembly according to claim 5, wherein said container comprises a backpack.

7. The snow and ice removal assembly according to claim 6, further including a hose being attached to and extending outwardly from said container, said hose being fluidly coupled with an interior of said container.

8. The snow and ice removal assembly according to claim 1, further including:

a motor being mounted in said chamber; and a spreader being mounted in said chamber and being mechanically coupled to said motor, said motor being actuated to rotate said spreader to move the melting compound from said inlet pipe and to said outlet pipe.

9. The snow and ice removal assembly according to claim 8, further including a power switch being mounted on said housing, said power switch being electrically coupled to said motor, said power switch being actuated to turn on said motor.

10. The snow and ice removal assembly according to claim 1, wherein said power supply comprises a rechargeable battery.

11. A snow and ice removal assembly comprising:

a housing having a front wall, a back wall and a peripheral wall extending between said front wall and said back wall;

a hot air conduit being fluidly coupled to said housing, said hot air conduit extending away from said front wall;

an air warming unit being mounted in said housing, said air warming unit drawing air into said housing through an air intake extending through said housing and warming the air when said air warming unit is turned on, said air warming unit forcing said air outwardly of said housing through said hot air conduit;

a container being positioned remote of said housing, said container being configured to hold snow melting compound therein, said container having a filling aperture for receiving the snow melting compound and a cap being removably positioned over said filling aperture, said container comprising a backpack;

a dispensing unit being mounted on said housing and being fluidly coupled to said container, said dispensing unit being actuated to extract the snow melting compound from said container and dispense the snow melting compound outwardly from said housing such that the snow melting compound melts the snow and the ice positioned on the ground surface;

a power supply being mounted on said housing, said power supply being electrically coupled to said air warming unit and said dispensing unit;

a hose being attached to and extending outwardly from said container, said hose being fluidly coupled with an interior of said container; and wherein said dispensing unit comprises a chamber being mounted within said housing, said chamber having a first lateral wall, a second lateral wall and a perimeter wall being attached to and extending between said first lateral wall and said second lateral wall.

12. The snow and ice removal assembly according to claim 11, further including an inlet pipe being fluidly coupled to an interior said chamber and extending outwardly of said housing, said hose being fluidly coupled to said inlet pipe to fluidly couple said chamber to said container.

13. The snow and ice removal assembly according to claim 12, further including an outlet pipe being fluidly coupled to said interior of said chamber and extending outwardly of said housing, said outlet pipe extending downwardly from said housing.

14. A snow and ice removal assembly comprising:

a housing having a front wall, a back wall and a peripheral wall extending between said front wall and said back wall, a handle being attached to a top side of said housing;

a hot air conduit being fluidly coupled to said housing, said hot air conduit extending away from said front wall, said hot air conduit comprising an elongated tube, said elongated tube having an open distal end relative to said housing, said elongated tube being rigid;

an air warming unit being mounted in said housing, said air warming unit drawing air into said housing through an air intake extending through said housing and warming the air when said air warming unit is turned on, said air warming unit forcing said air outwardly of said housing through said hot air conduit, said air warming unit comprising:

a control circuit being mounted in said housing;

a heating element being mounted in said housing and being electrically coupled to said control circuit, said heating element being in thermal communication with the air positioned within said housing, said heating element being actuated to heat the air within said housing to a preselected temperature;

a blower being mounted in said housing and being electrically coupled to said control circuit, said blower being in fluid communication with the air heated by said heating element, said blower being in fluid communication with said hot air conduit, said blower being actuated to take in the air from outside of said housing through said air intake wherein said heating element warms the air and force the air outwardly of said hot air conduit;

an input being electrically coupled to said control circuit, said input being actuated to turn on each of said heating element and said blower, said input including a temperature selector to selectively choose a one of a plurality of temperature levels at which the air is to be heated, said temperature levels being between 65° F. and 95° F.;

a container being positioned remote of said housing, said container being configured to hold snow melting compound therein, said container having a filling aperture for receiving the snow melting compound, said container comprising a backpack, a cap being removably positioned over said filling aperture;

a hose being attached to and extending outwardly from said container, said hole being fluidly coupled with an interior of said container;

a dispensing unit being mounted on said housing and being fluidly coupled to said container, said dispensing unit being actuated to extract the snow melting compound from said container and dispense the snow melting compound outwardly from said housing such that the snow melting compound melts the snow and the ice positioned on the ground surface, said dispensing unit comprising:

a chamber being mounted within said housing, said chamber having a first lateral wall, a second lateral wall and a perimeter wall being attached to and extending between said first lateral wall and said second lateral wall;

an inlet pipe being fluidly coupled to an interior said chamber and extending outwardly of said housing, said hose being fluidly coupled to said inlet pipe to fluidly couple said chamber to said container;

an outlet pipe being fluidly coupled to said interior of said chamber and extending outwardly of said housing, said outlet pipe extending downwardly from said housing;

a motor being mounted in said chamber;

a spreader being mounted in said chamber and being mechanically coupled to said motor, said motor being actuated to rotate said spreader to move the melting compound from said inlet pipe and to said outlet pipe;

an power switch being mounted on said housing, said power switch being electrically coupled to said spreader, said power switch being actuated to turn on said spreader; and a power supply being mounted on said housing, said power supply being electrically coupled to said air warming unit and said dispensing unit, said power supply comprising a rechargeable battery.

* * * * *